US007886844B2

(12) United States Patent
Phillips

(10) Patent No.: US 7,886,844 B2
(45) Date of Patent: Feb. 15, 2011

(54) BOREHOLE SURVEY METHOD AND APPARATUS

(75) Inventor: Wayne J. Phillips, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 220 days.

(21) Appl. No.: 12/169,382

(22) Filed: Jul. 8, 2008

(65) Prior Publication Data

US 2009/0120690 A1 May 14, 2009

Related U.S. Application Data

(60) Provisional application No. 60/987,310, filed on Nov. 12, 2007.

(51) Int. Cl.
*E21B 47/00* (2006.01)

(52) U.S. Cl. ..... 175/24; 175/45

(58) Field of Classification Search ..... 175/24, 175/40, 45

See application file for complete search history.

(56) References Cited

U.S. PATENT DOCUMENTS

| | | | | |
|---|---|---|---|---|
| 5,103,920 | A * | 4/1992 | Patton | 175/45 |
| 5,901,795 | A * | 5/1999 | Tsao et al. | 175/45 |
| 6,549,854 | B1 * | 4/2003 | Malinverno et al. | 702/16 |
| 6,633,816 | B2 | 10/2003 | Shirasaka et al. | |

OTHER PUBLICATIONS

Williamson, "Accuracy Prediction for Directional Measurement while Drilling," SPE 67616 (2000).

* cited by examiner

*Primary Examiner*—William P Neuder
(74) *Attorney, Agent, or Firm*—Dave R. Hofman

(57) ABSTRACT

A method includes obtaining a first set of survey data at a first point along a wellbore, estimating a present wellbore position based on at least the first set of survey data, determining a related ellipse of uncertainty at the present wellbore position, comparing the related ellipse of uncertainty of the present wellbore position to a threshold, and selecting a methodology for a subsequent survey based on a comparison of the related ellipse of uncertainty to the threshold.

16 Claims, 6 Drawing Sheets

BOREHOLE SURVEY METHOD AND APPARATUS

RELATED APPLICATIONS

This application is related to U.S. Pat. No. 6,633,816 filed Jul. 31, 2001, entitled "Borehole Survey Method Utilizing Continuous Measurements" to Shirasaka, Phillips, and Tejada.

This application claims priority to provisional U.S. Patent Application Ser. No. 60/987,310 filed Nov. 12, 2007, entitled "Continuous Direction and Inclination for Wellbore Trajectory Surveys and Planning" to Phillips, assigned to the assignee of the present invention, and incorporated herein in its entirety by reference.

TECHNICAL FIELD

This invention relates generally to making downhole measurements during the drilling of a borehole to recover natural deposits of oil or gas and, more particularly, to using continuous downhole measurements to directionally drill the borehole while optimizing time spent in stationary surveys.

BACKGROUND

Wellbores are drilled to locate and produce hydrocarbons. A downhole drilling tool with a bit at end thereof is advanced into the ground to form a wellbore. As the drilling tool is advanced, a drilling mud is pumped from a surface mud pit, through the drilling tool and out the drill bit to cool the drilling tool and carry away cuttings. The fluid exits the drill bit and flows back up to the surface for recirculation through the tool.

Fluids, such as oil, gas and water, are commonly recovered from subterranean formations below the earth's surface. Drilling rigs at the surface are often used to bore long, slender wellbores into the earth's crust to the location of the subsurface fluid deposits to establish fluid communication with the surface through the drilled wellbore. The location of subsurface fluid deposits may not be located directly (vertically downward) below the drilling rig surface location. A wellbore that defines a path, which deviates from vertical to some laterally displaced location, is called a directional wellbore. Downhole drilling equipment may be used to directionally steer the wellbore to known or suspected fluid deposits using directional drilling techniques to laterally displace the borehole and create a directional wellbore.

The path of a wellbore, or its "trajectory," may be determined by collecting a series of direction and inclination ("D&I") measurement at various points along the wellbore and by using known calculation methods. "Position," as the term is used herein, refers position of the wellbore, referenced to some vertical and/or horizontal datum (usually the wellhead position and elevation reference). The position may also be obtained using inertial measurement techniques. "Azimuth" may be considered, for present disclosure, to be the directional angular heading, relative to a reference direction, such as North, at the position of measurement. "Inclination" may be considered, also for present disclosure, to be the angular deviation of the borehole from the vertical, usually with reference to the direction of gravity. "Measured depth" may be considered, also for present disclosure, to be the distance measured along the wellbore from the surface location. Measured depth may include the driller's depth, and it may also include depth correction algorithms, that account for the elastic stretching and compression of the drill string along its length.

Directional wellbores are drilled through earth formations along a selected trajectory. Many factors may combine to unpredictably influence the trajectory of a wellbore. It is desirable to accurately measure the wellbore trajectory in order to guide the wellbore to its geological and/or positional target. Thus, it is desirable to measure the inclination, azimuth and depth of the wellbore during wellbore operations to estimate whether the selected trajectory is being maintained.

The drilled trajectory of a wellbore is estimated by the use of a wellbore or directional survey. A wellbore survey is made up of a collection or "set" of survey-stations. A survey station is generated by taking measurements used for estimation of the position and/or wellbore orientation at a single position in the wellbore. The act of performing these measurements and generating the survey data is termed "surveying the wellbore."

Many factors may combine to unpredictably influence the trajectory of a drilled borehole. It is important to accurately determine the borehole trajectory in order to determine the position of the borehole at any given point of interest and to guide the borehole to its geological objective. Surveying of a borehole using existing methods involves the intermittent measurement of the earth's magnetic and gravitational fields to determine the azimuth and inclination of the borehole at the BHA under static conditions; that is, while the BHA is stationary. These "static" surveys are generally performed at discrete survey "stations" along the borehole when drilling operations are suspended to make up additional joints or stands of drillpipe into the drillstring. Consequently, the along hole depth or borehole distance between discrete survey stations is generally from 30 to 90 feet corresponding to the length of joints or stands of drillpipe added at the surface.

Surveying of wellbores is commonly performed using downhole survey instruments. Such instruments typically contain sets of orthogonal accelerometers, magnetometers and/or gyroscopes. Survey instruments are used to measure the direction and magnitude of the local gravitational, magnetic field and/or earth spin rate vectors respectively, herein referred to as "earth's vectors." Various measurements correspond to the instrument position and orientation in the wellbore, with respect to earth vectors. Wellbore position, inclination and/or azimuth may be estimated from the instrument's measurements.

One or more survey stations may be generated using "discrete" or "continuous" measurement modes. Generally, discrete or "static" wellbore surveys are performed by creating survey stations along the wellbore when drilling is stopped or interrupted to add additional joints or stands of drillpipe to the drillstring at the surface. Continuous wellbore surveys relate to many measurements of the earth's vectors and/or angular velocity of a downhole tool obtained for each wellbore segment using the survey instruments. Successive measurements of these vectors during drilling operations may be separated by only fractions of a meter and, in light of the relatively slow rate of change of the vectors in drilling a wellbore, these measurements are considered continuous for all practical analyses. The art of continuous surveys is very well described in U.S. Pat. No. 6,633,816, which is assigned to the assignee of the present application and is incorporated herein by reference in its entirety.

Known survey techniques as used herein encompass the utilization of a variety of methodologies to estimate wellbore position, such as using sensors, magnetometers, accelerometers, gyroscopes, measurements of drill pipe length or wireline depth, Measurement While Drilling ("MWD") tools, Logging While Drilling ("LWD") tools, wireline tools, and the like.

Existing wellbore survey computation techniques use various methodologies, including the Tangential method, Balanced Tangential method, Average Angle method, Mercury method, Differential Equation method, cylindrical Radius of Curvature method and the Minimum Radius of Curvature method, to model the trajectory of the wellbore segments between survey stations.

Directional surveys may also be performed using wireline tools. Wireline tools are provided with one or more survey probes suspended by a cable and raised and lowered into and out of a wellbore. In such a system, the survey stations are generated in any of the previously mentioned surveying modes to create the survey. Sometimes wireline tools are used to survey wellbores after a drilling tool has drilled a wellbore and an MWD and/or LWD survey has been previously performed. In some examples, a wireline survey may be made of a partially drilled wellbore, and the results may be used in calculating the position of the wellbore once drilling commences again.

Uncertainty in the survey results from measurement uncertainty, as well as environmental factors. Measurement uncertainty may exist in any of the known survey methodologies. For example, magnetic measuring techniques suffer from the inherent uncertainty in global magnetic models used to estimate declination at a specific site. Similarly, gravitational measuring techniques suffer from movement of the downhole tool and uncertainty in the accelerometers. Gyroscopic measuring techniques, for example, suffer from drift uncertainty. Depth measurements are prone to uncertainty including mechanical stretch from gravitational forces and thermal expansion and compression from the weight on bit, for example.

Additionally, for each methodology, there is a trade-off between time required to complete the survey and the resulting resolution and degree of accuracy.

Various considerations have brought about an ever-increasing need for more precise wellbore surveying techniques. More accurate survey information is necessary to ensure the avoidance of well collisions and the successful penetration of geological targets.

SUMMARY

In one aspect, a method includes obtaining a first set of survey data at a first point along a wellbore, estimating a present wellbore position based on at least the first set of survey data, determining a related ellipse of uncertainty at the present wellbore position, comparing the related ellipse of uncertainty of the present wellbore position to a threshold, and selecting a methodology for a subsequent survey based on a comparison of the related ellipse of uncertainty to the threshold.

In another aspect, an article comprising a computer accessible storage medium to store instructions that, when executed, cause a processor-based system to obtain a first set of survey data at a first point along a wellbore, estimate a present wellbore position based on at least the first set of survey data, determine a related ellipse of uncertainty at the present wellbore position, compare the related ellipse of uncertainty of the present wellbore position to a threshold, and select a methodology for subsequent survey based on a comparison of the related ellipse of uncertainty and the threshold.

In another aspect, a method for continuous direction and inclination in wellbore trajectory surveying and planning includes obtaining a first set of survey data according to a first survey methodology, obtaining a second set of survey data according to a second survey methodology, calculating a present wellbore position according to at least the first and second sets of survey data, the present wellbore position having a related ellipse of uncertainty, comparing the ellipse of uncertainty to a threshold, and selecting a methodology for at least a third survey. The first survey methodology may consume more rig time and results in higher accuracy relative to the second survey methodology.

DETAILED DESCRIPTION

Figure 1:
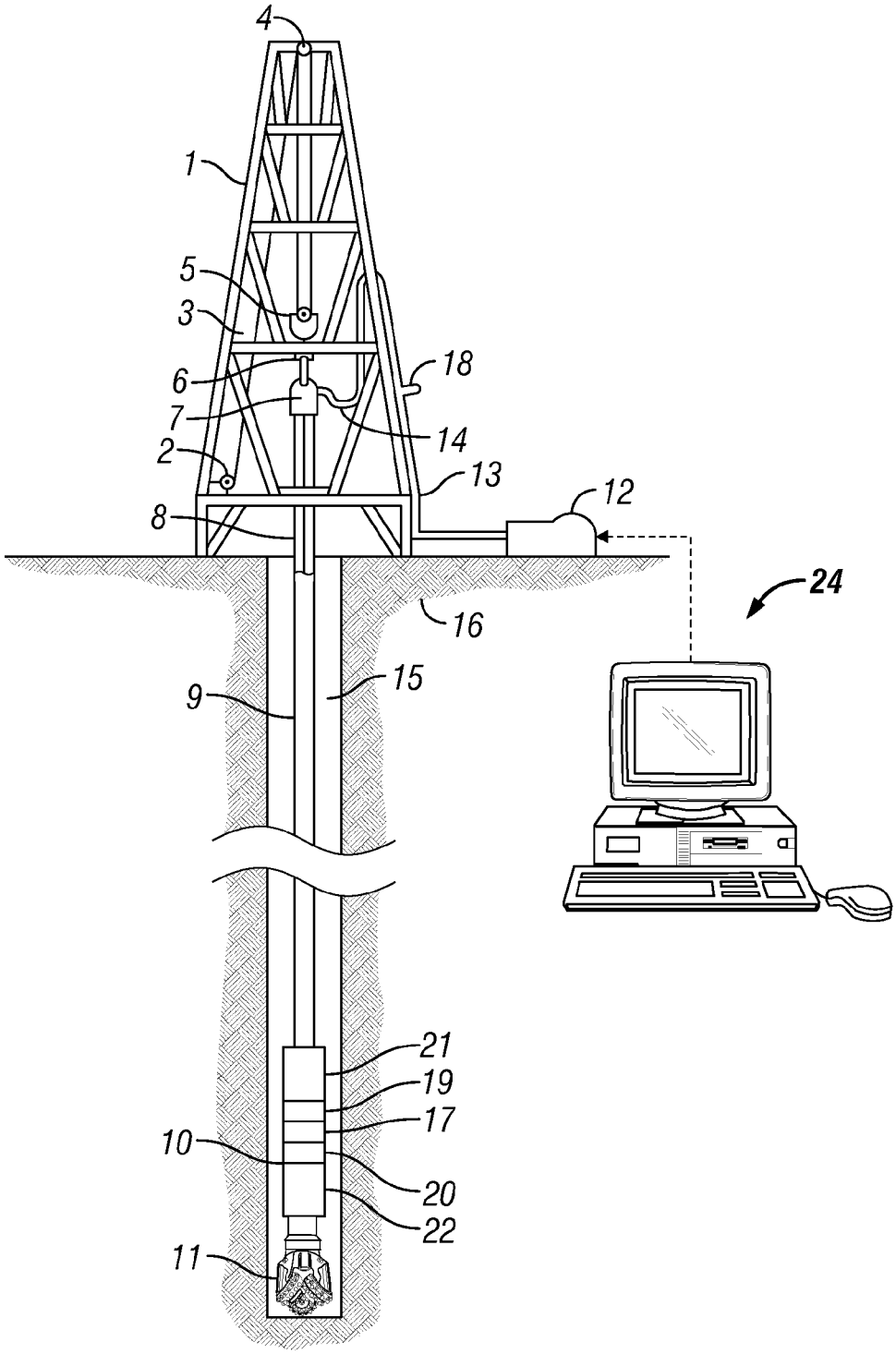
FIG. 1 shows a typical drilling operation comprising a drilling rig, a drillstring including a survey instrument, a drilling mud circulating system and a data processor.

In the following description, like or identical reference numerals are used to identify common or similar elements. The figures are not necessarily to scale and certain features and certain views of the figures may be shown exaggerated in scale or in schematic in the interest of clarity and conciseness.

Illustrative examples are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

"Azimuth data," "inclination data" and "azimuth and inclination data," as those terms are used herein, mean either the raw measurements of the earth's magnetic and gravitational fields or the estimates of borehole azimuth and inclination obtained using such raw measurements of the earth's magnetic and gravitational fields. The decision as to whether to process raw data or estimates downhole in a tool or by computer at surface should be based on telemetry capacity, microprocessor capacity and other considerations.

The azimuth and inclination data may be obtained using conventional survey instruments, and transmitted to the surface using one or more known telemetry methods. The survey instruments and the telemetry instruments may be included in the BHA that is run into a borehole in a drillstring comprising connected joints of tubular pipe and having a drill bit at its bottom, leading end. The drillstring is coupled at the surface to a drilling rig which provides torque for rotating the drillstring.

In accordance with the present disclosure, the selection of which survey methodology to apply may be based upon the desire to avoid unnecessary time spent making unnecessary surveys and the associated time to telemeter the data to the surface (for example, drilling downtime for a static survey costs rig time and risks the BHA becoming stuck). On the other hand, if the presently calculated wellbore position has an ellipse of uncertainty that exceeds a predetermined threshold, a higher resolution, more time intensive survey may be selected at closer distance (depth). The present disclosure enables the selection of whether to perform a survey at all, as well as which methodology to use and how close to the current depth, to be made in real time and applied to change the survey plan, and as needed, adjust one or more drilling parameters to realign the actual trajectory of the well with the planned trajectory. "Survey methodology" is meant to include the type of survey performed, the timing for performing the survey, the location of the survey or the distance between surveys, the equipment used to make the survey, and other parameters associated with a survey. "Survey methodology" may include multiple surveys, as well.

FIG. 1 is a depiction of a typical drilling rig engaged using the described drillstring to drill a borehole. The drilling equipment includes a derrick 1, drawworks 2, cable 3, crown block 4, traveling block 5, and hook 6, supporting a drillstring which includes a swivel joint 7, kelly 8, drillpipe 9, drill collars 10, and drill bit 11. Mud pumps 12 circulate drilling fluid through a standpipe 13 and flexible hose 14, down through the hollow drillstring and back to the surface through the annular space 15 between the drillstring and the borehole wall 16.

Figure 2:
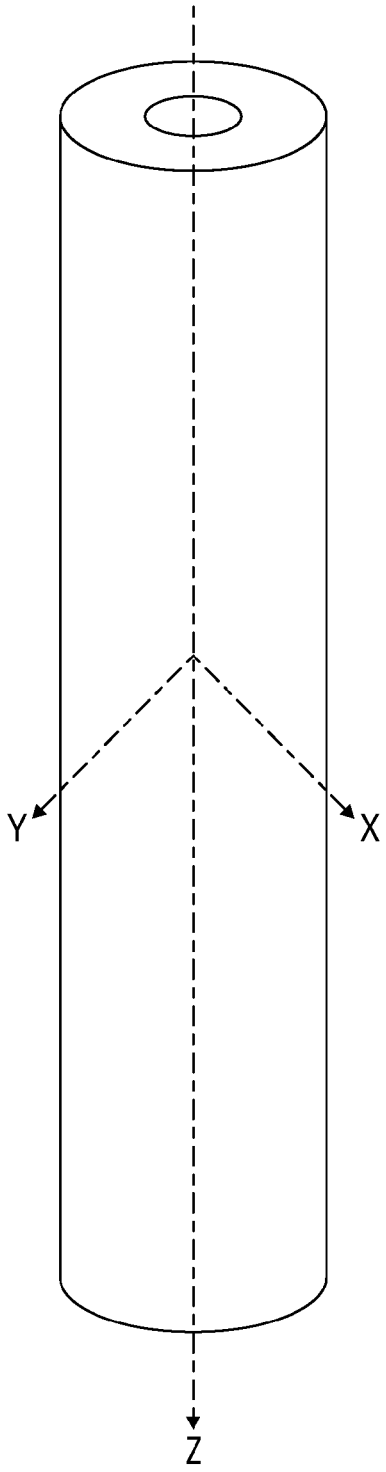
FIG. 2 is a schematic illustration of a survey instrument showing the origin of the tool-fixed coordinate system used in borehole surveys.

During the course of drilling a borehole for oil or gas production, it is advantageous to measure, from time to time, the azimuth and inclination of the borehole, as well as the borehole depth, in order to determine its trajectory and to directionally guide the borehole to its subsurface objective or target (such as, for example, another well or a subsurface reservoir). The survey tool 17 is generally located within a drill collar 10, and it may measure the direction and magnitude of the earth's local gravitational and magnetic fields. In one example, a survey tool 17 may measure the earth's gravitational and magnetic fields with respect to a tool-fixed coordinate system having its origin within the survey tool, as shown in FIG. 2. Measurements of the earth's magnetic and gravitational fields are used to estimate the azimuth and inclination of the borehole at a point of measurement. The present disclosure and existing methods may also make use of gyroscopes. Using existing methods, it is customary to take at least one static survey each time drilling operations are interrupted to add a new section or sections of drillpipe to the drillstring at the surface.

Again referring to FIG. 1, the measured azimuth and inclination data measured by the survey tool 17 may be transmitted to the surface using any method of telemetry, such as mud-pulse telemetry, electromagnetic telemetry, acoustic telemetry, and wired drill pipe, among others. The data processing system 24 is programmed to receive the measurement data that has been telemetered to the surface and calculate one or more conventional wellbore orientation indicators like azimuth, inclination, toolface and like.

The borehole inclination at any given point can be determined by use of the gravitational measurements alone. The borehole azimuth at any given point can be determined from both the gravitational and magnetic measurements. When drilling operations are suspended to add joints of pipe to the drillstring at the surface, borehole azimuth and inclination data may be obtained through a static survey. The results may be telemetered to the surface for analysis.

As such, various methods, both known and currently under development, for obtaining continuous survey data while drilling may be used in addition to such static surveys. One example of continuous survey data acquisition and processing is described in related U.S. Pat. No. 6,633,816. Additional existing methods are also known, including averaging azimuth (or inclination) data during a moving time window to estimate the true azimuth (or inclination) at a given borehole depth from the average of the values obtained during a selected time period. The selection of any particular continuous survey algorithm is not intended to be limiting on the present disclosure.

Figure 3:
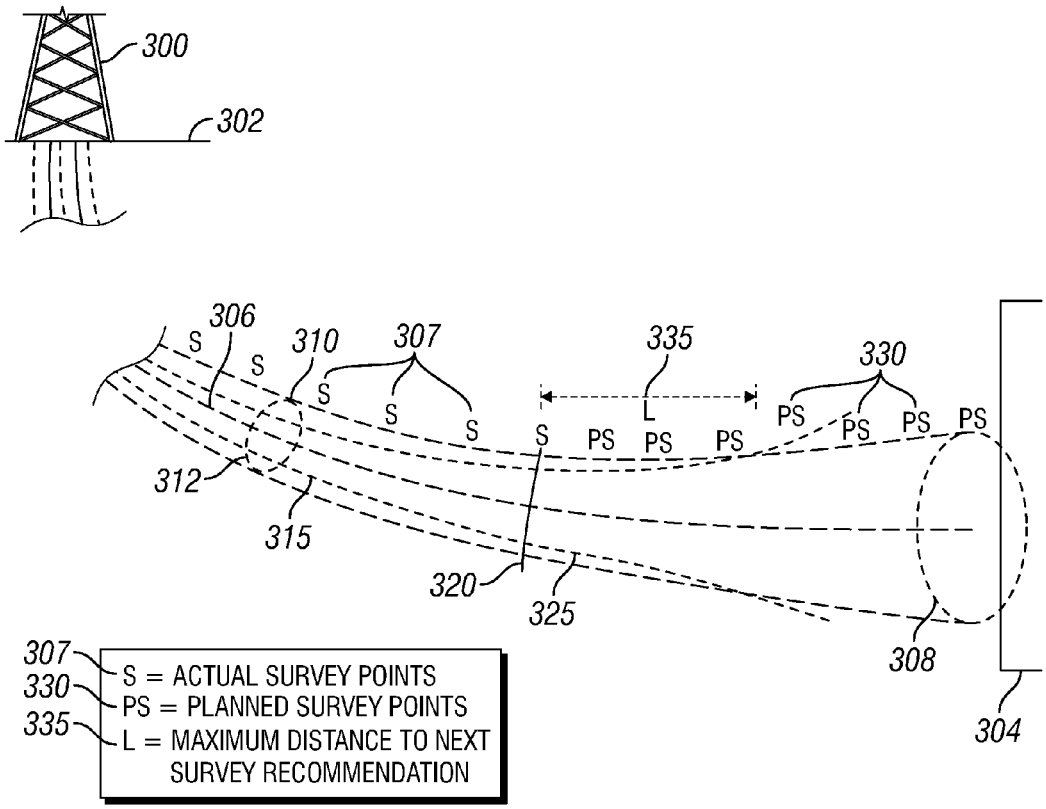
FIG. 3 shows a drilling operation extending to a subterranean target along a planned trajectory with a predetermined ellipse of uncertainty about the trajectory intended for reaching the target with a certain degree of accuracy.

Referring now to FIG. 3, a drilling operation is shown, with a rig 300 at the surface 302, drilling towards a subterranean target 304 along a planned trajectory 306 for reaching the target 304 within a certain ellipse of uncertainty 308 about the point for entry in the subterranean target 304. Extending along the planned trajectory 306, if the actual drilled trajectory is within a particular tolerance or threshold (shown defined by the dashed lines 310 which can also be represented as series of ellipse of uncertainty 312), at any given point along the trajectory there is also defined a predetermined ellipse of uncertainty. The ellipse of uncertainty, as accepted in the industry, refers to a given degree of inaccuracy of a calculated wellbore position, based on inaccuracies in surveying and position calculation for determining the wellbore position. An example of calculation of uncertainty is well described in SPE67616, titled "Accuracy Prediction for Directional Measurement While Drilling," by Williamson (2000). Other methods are also known in the industry and may be used in addition to these techniques. The solution of any particular technique or algorithm is not intended to be limiting on the present disclosure. As shown at 320, the current position at which the last survey was done. The solid line 315 is the actual ellipse of uncertainty calculated along the actual trajectory 306 from all the previous stationary surveys "S" 307. The dashed line, 325, shows the computed uncertainty ellipse if none of the planned surveys "PS", 330 will be acquired. In this case the method disclosed here will calculate the next surveying methodology (which may include type of survey, time allowed resulting in corresponding accuracy) at maximum distance or depth, "L," 335, where the next survey must be acquired without crossing the allowable uncertainty, 310. In this case the time of few surveys could be saved and the driller can drill to the next survey point as fast as possible to save time. If there were continuous survey available during drilling, these can be included in the computation to calculate the distance where the stationary survey must be acquired.

Figure 4:
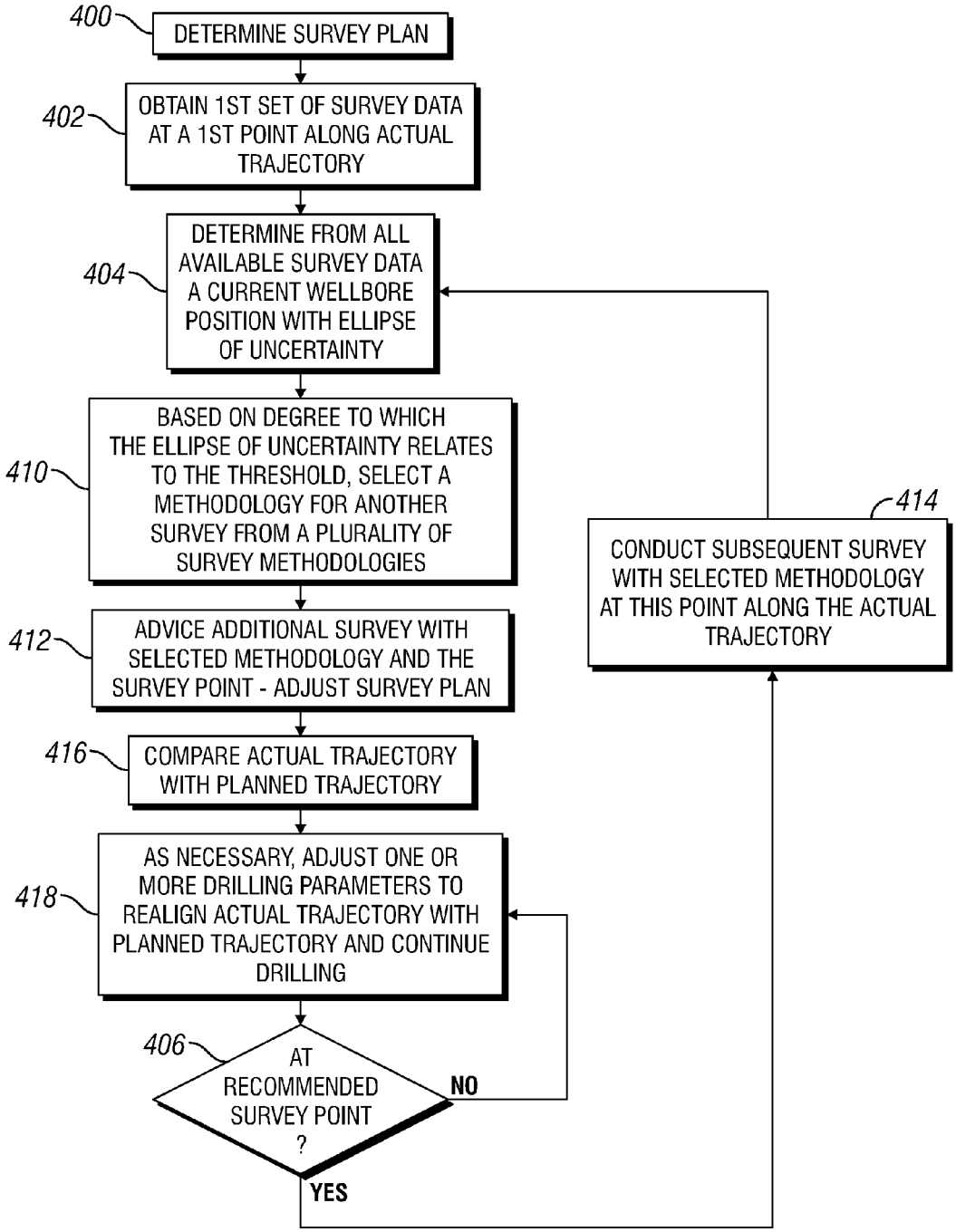
FIG. 4 is a flow chart showing steps of an example method for making one or more surveys.

FIG. 4 is a flow chart showing steps of a general method in accordance with one embodiment of the present disclosure, enabling real time selection of a survey methodology based on whether the ellipse of uncertainty about the present wellbore position indicates that drilling is "on track" within a threshold to meet the intended target.

The method begins with determining a survey plan (block 400). The survey plan may be originated before drilling begins, and typically includes surveys of various methodologies according to what is occurring in drilling at any given point in time. The planned surveys also have an associated allowable uncertainty that is calculated such that the wellbore will reach the target with known uncertainty. The survey plan may be updated during drilling based on the drilling and formation evaluation information received in real time from downhole.

At some point during drilling, a first set of survey data at a first point along the actual trajectory is obtained (block 402) as shown in FIG. 4. The first set of survey data may have a first survey methodology, with an associated time for completion and a resulting resolution and accuracy. It is noted that the first set of survey data may not be the actual first survey taken while drilling a well. The terminology is used here for convenience to distinguish between earlier and later surveys.

The current wellbore position may be determined using at least a portion of the most recent survey data, as well as the available or accepted survey data (step 404). The wellbore position may be determined and associated with the position of the BHA at the location for the survey, or within a certain proximity of where the survey is taken. Based on the survey and the BHA design, the bit location and associated ellipse of uncertainty can be determined.

Based on a comparison between the ellipse of uncertainty and the predetermined threshold, the method proceeds to, select a methodology for another survey from a plurality of survey methodologies and compute the distance or point from the current (block 410). For example, when the ellipse of uncertainty has grown so large as to exceed the threshold, an additional survey with a high resolution at very short distance will be suggested to add more certainty. Such action may result in calculation of the wellbore position with an ellipse of uncertainty that is within the threshold after the subsequent survey, ensuring drilling accurately to the target. It is possible in extreme case, multiple high accuracy surveys at short distances needed such that the rate of increase in uncertainty is slower than the rate of increase in allowable threshold along the wellbore to bring the ellipse of uncertainty within the threshold. In other cases, it may be that if the uncertainty is well within the threshold, and a survey may be suggested at a much longer distance with lower accuracy, thereby saving time needed to acquire and telemeter to surface location unneeded surveys.

The method then proceeds with advising a subsequent survey with the selected methodology and the distance or point from the current position where the next survey to be taken (block 412). In the case of drilling controlled manually by a driller, an additional static survey may be advised by generation of a notification to the driller. In the case of automated drilling where a human driller is not always present, an additional survey may be advised in the form of a computer command at appropriate depth. This advice of survey is fed back such that the survey plan is updated.

It is noted the methodology may include the position and the type of survey to be performed. In one example, the uncertainty may be well within acceptable limits, and the methodology may be to skip the next planned static survey. In another example, where the uncertainty is determined to be large, the methodology may include advising a static survey in addition to those already planned.

With the wellbore position calculated, the method proceeds with comparing the actual trajectory with the planned trajectory to determine if drilling is "on track" (block 416). Based on how far the actual trajectory is from the planned trajectory, the method may proceed with adjusting one or more drilling parameters to realign the actual trajectory with the planned trajectory (block 418) and continue drilling.

The method checks frequently if the drilling has reached to the recommended point according to the advice in block 412 (block 406). If that point is not reached the method continues with drilling and adjusts the drilling parameters as needed to drill according the planned trajectory. If the point is reached the survey is conducted with the selected methodology at that point along the actual trajectory or at next convenient point, such as at the end of a stand (block 414). Once the survey is taken the method goes back to computing the ellipse of uncertainty at the survey point (block 404).

Figure 5:
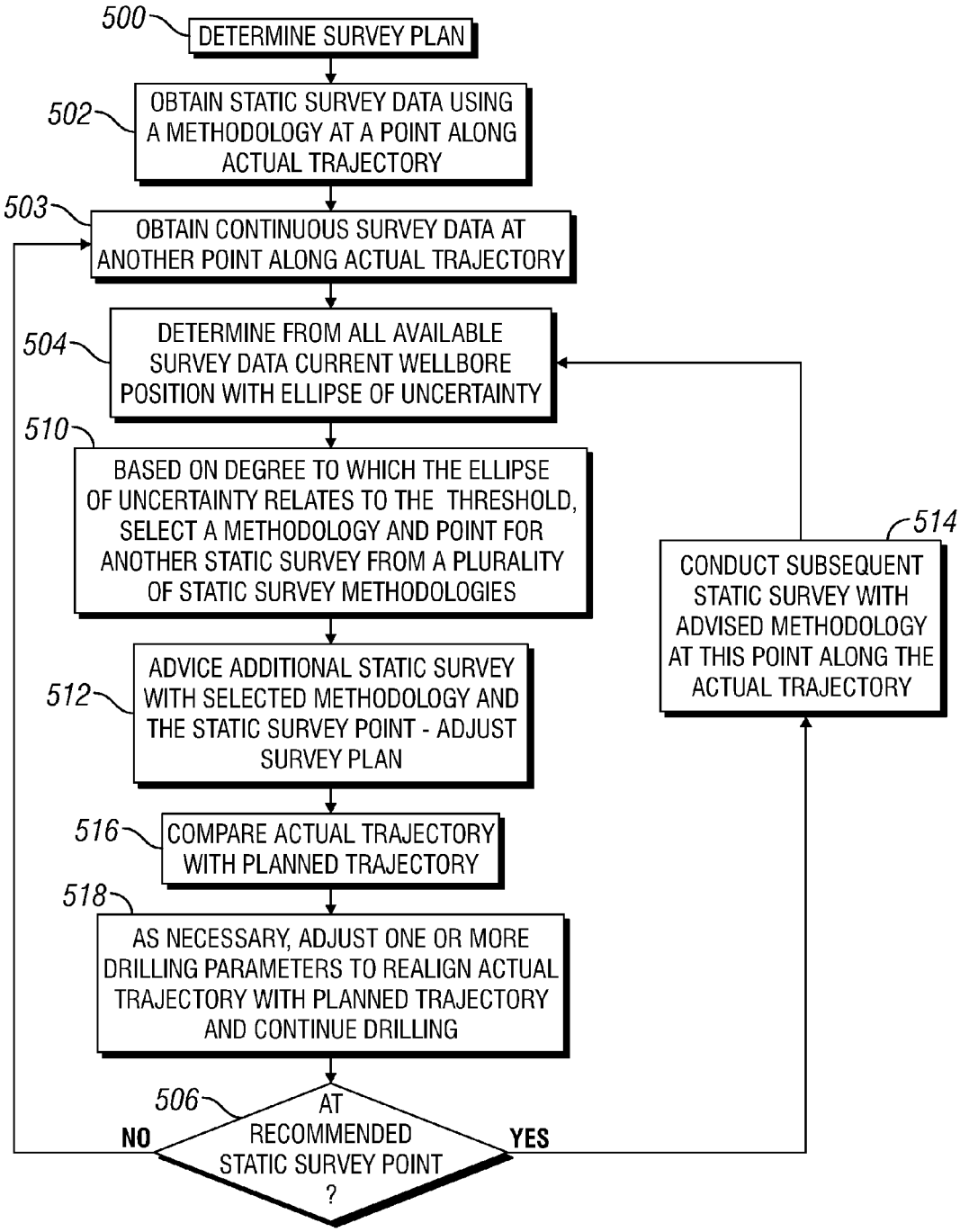
FIG. 5 is a flow chart showing steps of another example method for making one or more surveys.

Steps of an example method in accordance with the present disclosure are shown in the flowchart in FIG. 5. In the example method of FIG. 5, the survey methodologies that may be selected include static or continuous surveys. In block 500, a survey plan is determined. In this example, a survey plan generally includes a planned trajectory for reaching a given target, and in order to accurately reach the target, a series of static and continuous surveys are planned. The survey plan is subject to change while drilling, based on the calculated ellipse of uncertainty at a certain point.

In block 502, static survey data is obtained. In this example, a static survey comprises a first survey methodology. As previously described, static survey data is obtained by halting drilling, such as at the end of a stand or any other time in drilling that indicates a convenient time to temporarily stop drilling. The end of a stand is commonly understood as being a convenient time to perform a static survey since drilling is halted in order to add drill pipe for the stand to be subsequently drilled. The static survey data may be obtained at any time, however, as outlined in the survey plan.

In block 503, continuous survey data is obtained. As previously described, continuous survey data is obtained while drilling continues. In this example, a continuous survey comprises a second survey methodology. The continuous survey data may be obtained at any interval while drilling. The interval for obtaining continuous survey data may be determined as a function of time since the last survey (static or continuous) or as a function of depth of the wellbore for example. In some embodiments, the interval may be defined in the survey plan. In block 504, the wellbore position is calculated and the ellipse of uncertainty about the position of the wellbore is analyzed It is noted that some survey data may be discarded if the results are well out of expected norms. Unforeseen circumstances, for example, a highly magnetic material in the formation near the survey tool, may cause such significant error that the survey data may be discarded. In some cases, the unsuitability of a particular data set may not be realized until after drilling has resumed. This may necessitate a further determination of the uncertainty and a change in the survey plan and/or methodology.

Based on a comparison of the ellipse of uncertainty relates to the predetermined threshold, the method may proceed to select a methodology for another static survey from a plurality of static survey methodologies and compute the distance or point from current position where the next survey to be taken (block 510). For example, when the ellipse of uncertainty has grown so large as to exceed the threshold, an additional static survey with a high resolution at a very short distance may be advised. It is possible in an extreme case, multiple high accuracy static surveys at short distances needed such that the rate of increase in uncertainty is slower than the rate of increase in allowable threshold along the wellbore to bring the ellipse of uncertainty within the threshold. In another example, it may be that if the uncertainty is well within the threshold, a static survey may be suggested at a much longer distance with lower accuracy saving time needed to acquire and telemeter unneeded static surveys to surface location.

The method then proceeds with advising an additional static survey with the selected methodology and the distance or point from the current position where the next survey to be taken (block 512). In the case of drilling controlled manually by a driller, an additional static survey may be advised by generation of a notification to the driller. In the case of automated drilling where a human driller is not always present, an additional static survey may be advised in the form of a computer command at appropriate depth. This advice of static survey is fed back, such that the survey plan is updated. In various embodiments, methods in accordance with the present disclosure minimize the number of static surveys in the survey plan in order to minimize downtime for the drilling rig.

With the wellbore position calculated and static survey advised, the method proceeds with comparing the actual trajectory with the planned trajectory to determine if drilling is "on track" (block 516). Based on how far the actual trajectory is from the planned trajectory, the method proceeds with adjusting one or more drilling parameters to realign the actual trajectory with the planned trajectory (block 518). Drilling continues at this point.

The method checks frequently if the drilling has reached to the recommended point according to the advice in block 512 (block 506). If that point is not reached the method goes back to acquire next continuous survey while drilling continues (block 503).

If the recommended static survey point is reached the static survey is conducted at next convenient point with the selected methodology along the actual trajectory (block 514). Once the survey is taken the method may continue to compute the ellipse of uncertainty with data that may include all available or accepted surveys at that point (block 504).

Figure 6:
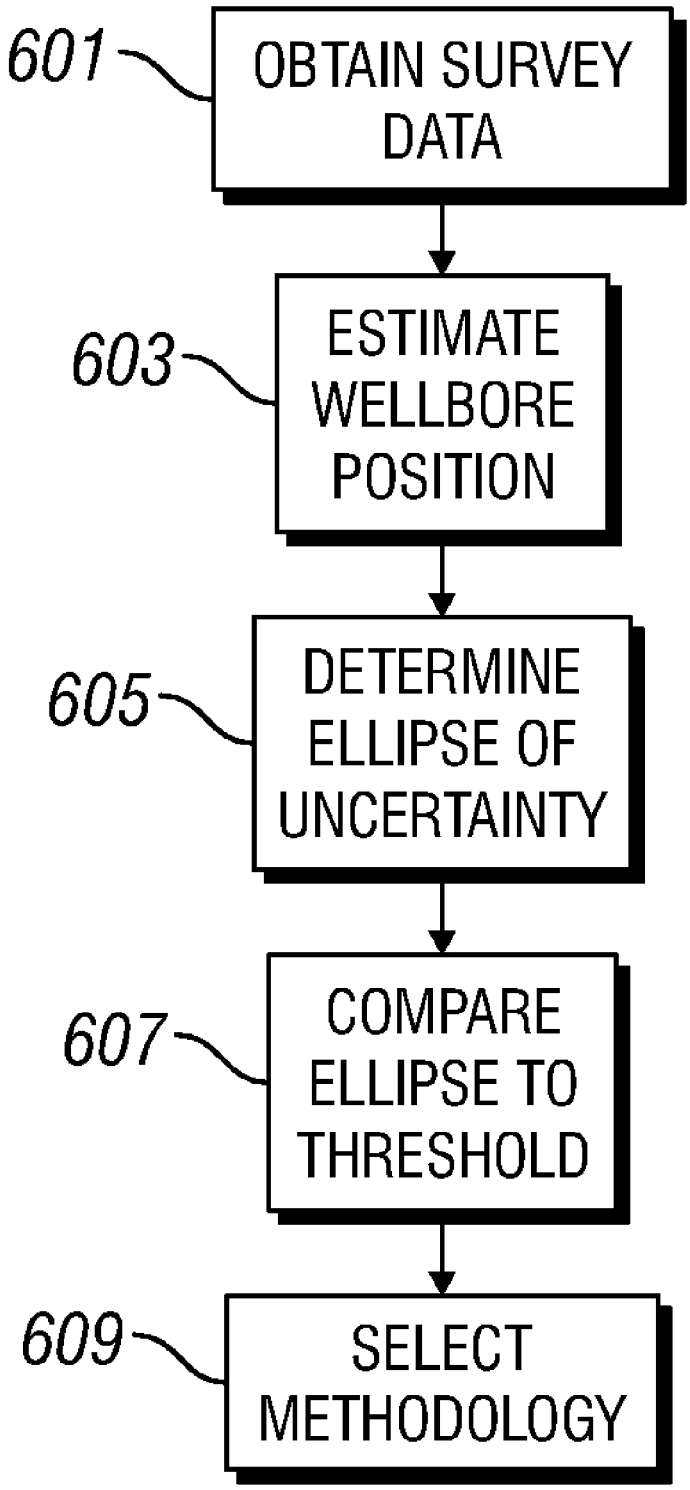
FIG. 6 is a flow chars showing steps of another example method for making one or more surveys.

FIG. 6 shows another example method for making surveys of a wellbore. The method may include obtaining a first set of survey data (block 601). The first set of survey data may be obtained through any means. For example, the first set of survey data may be obtained through a static survey that is made during the normal course of drilling. In another example, the first set of survey data may include data from a continuous survey measurement. In yet another example, the first set of survey data may be obtained from a gyro measurement, which may be done during drilling or as part of a wireline run. Further, it is noted that "first" is not used to denote the very first survey that is taken of the wellbore. In this example method, "first" is merely used to distinguish this set of survey data from others.

It is also noted that the step of obtaining survey data may be done by using sensors to collect the data. In some examples, the data may be transmitted to the surface through a telemetry system. In another example, the first set of survey data may be collected by another party or at another time, and the survey data may be obtained for analysis.

Next, the method may include estimating the wellbore position using at least the first set of survey data (block 603). This may also include the use of the depth of the survey measurement, as well as other survey data that may be relevant. Estimating the wellbore position may also include the use of other information or data that is available, such as formation evaluation data.

Next, the method may include determining a ellipse of uncertainty for the wellbore position (block 605). Uncertainty is the result of inaccuracies in measurement, as well as other factors that are known in the art. Based on the survey data, an uncertainty relating to the position may be determined.

Next, the method may include comparing the ellipse of uncertainty to a threshold uncertainty that is acceptable (block 607). This step may determine the relationship of the uncertainty of the position to the threshold. For example, if the uncertainty is greater than the threshold, that may indicate that more accurate surveys are needed. In another example, the comparison may determine that the uncertainty is less than the threshold, indicating that the survey plan is acceptable or that the survey plan includes surveys that are unnecessary to maintain an acceptable uncertainty. It is noted that an uncertainty that is smaller than the threshold may nonetheless be a cause for recommending a new survey methodology. For example, it may be determined that the uncertainty is growing at a rate that may cause it to later exceed the threshold, and more accurate or more frequent surveys may be recommended.

The method may next include selecting a survey methodology for a subsequent survey (block 609). In this context, "methodology" is meant to include both they type or survey and the timing/location of the survey. Thus, a particular methodology may include taking a static survey at the next pause in drilling for connecting additional drill pipe segments. In another example, a methodology may include collecting continuous survey data over a particular drilling length. In yet another example, a methodology may include an unplanned halt in drilling to perform a static survey or a gyro survey.

The methodology may be based on several factors, including the relationship between the uncertainty and the threshold, the distance to the target, the time and cost of the various methodologies, and other factors. For example, if the uncertainty is well within the threshold, a methodology may be selected that include not performing a planned static survey, so that the drilling time may be saved. Such a selection may be based on the fact that an accurate survey is not needed because of the relatively low uncertainty. In another example, an unplanned static or gyro survey may be recommended because, even though it will consume rig time, the increase in accuracy will result in a relatively lower uncertainty compared to the threshold, which may be required to achieve the drilling accuracy objectives.

Methods in accordance with the present disclosure are independent of mode of transmission of DH data to surface and can be applied to mud pulse telemetry, electromagnetic telemetry, wired drill pipe telemetry, wireline telemetry or any other transmission methods.

Methods in accordance with the present disclosure method may process data using downhole micro-processors, or data may be first transmitted to the surface and there processed using computers to refine the data and eliminate or reduce error from unwanted shock, vibrations and nose from drilling.

Methods in accordance with the present disclosure are applicable to either measurement-while-drilling or wireline operations.

Methods in accordance with the present disclosure can also be applied while drilling down or reaming up during which the survey data is acquired.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method, comprising:

obtaining a first set of survey data at a first point along a wellbore;

estimating a present wellbore position based on at least the first set of survey data;

determining a related ellipse of uncertainty at the present wellbore position;

comparing the related ellipse of uncertainty of the present wellbore position to a threshold;

selecting a methodology for a subsequent survey based on a comparison of the related ellipse of uncertainty to the threshold; and comparing an actual trajectory of the wellbore to a planned trajectory of the wellbore.

2. The method according to claim 1, further comprising displaying the selected methodology.

3. The method according to claim 1, further comprising transmitting the selected methodology to an automated drilling system.

4. The method according to claim 1, wherein the first set of survey data comprises data from a static survey.

5. The method according to claim 4, further comprising obtaining at least one set of continuous survey data, and wherein estimating the present wellbore position is based on at least the first set of survey data and the at least one set of continuous survey data.

6. The method according to claim 1, further comprising:

obtaining a second set of survey data at a second point along the wellbore, wherein the second point is farther along the wellbore compared to the first point; and rejecting the second set of survey data, wherein the determining the related uncertainty at the present wellbore position is not based on the second set of survey data.

7. The method according to claim 1, wherein the selected methodology comprises skipping at least one preplanned survey.

8. The method according to claim 1, wherein the selected methodology comprises at least one additional survey prior to a next preplanned survey.

9. The method according to claim 1, wherein the selected methodology comprises modifying a type of survey for a next preplanned survey.

10. The method according to claim 1, further comprising conducting the subsequent survey according to the selected methodology at a second point along the wellbore.

11. The method according to claim 1, wherein the selected methodology is selected from a plurality of survey methodologies, each methodology having a related survey time and survey accuracy associated therewith, and wherein the selection of methodology is based at least in part on the comparison between the related uncertainty and the threshold and on the available survey time and the survey accuracy of the plurality of survey methodologies.

12. A method for continuous direction and inclination in wellbore trajectory surveying and planning, the method comprising:

obtaining a first set of survey data according to a first survey methodology;

obtaining a second set of survey data according to a second survey methodology;

calculating a present wellbore position according to at least the first and second sets of survey data, the present wellbore position having a related ellipse of uncertainty; and comparing the ellipse of uncertainty to a threshold; and selecting a methodology for at least a third survey, wherein the first survey methodology consumes more rig time and results in higher accuracy relative to the second survey methodology.

13. The method according to claim 12, wherein the first survey methodology comprises a static survey methodology and the second survey methodology comprises a continuous survey methodology.

14. The method according to claim 12, wherein the third survey is performed according to the first survey methodology.

15. The method according to claim 14, further comprising:

halting drilling at a point along the actual trajectory;

obtaining a third set of survey data according to the first survey methodology; and resuming drilling.

16. The method according to claim 12, wherein the first set of survey data and the second set of survey data are obtained using at least one selected from an accelerometer, a magnetometer, and a gyroscope.

* * * * *